US007125138B2

(12) United States Patent
Reinmann

(10) Patent No.: US 7,125,138 B2
(45) Date of Patent: Oct. 24, 2006

(54) ETERNAL MEMORIAL LIGHT

(76) Inventor: Molly Denise Reinmann, 753 A Walker Rd., Jackson, IN (US) 38305

( * ) Notice: Subject to any disclaimer, the term of this patent is extended or adjusted under 35 U.S.C. 154(b) by 251 days.

(21) Appl. No.: 10/612,845

(22) Filed: Jul. 7, 2003

(65) Prior Publication Data

US 2005/0007764 A1 Jan. 13, 2005

(51) Int. Cl.
*F21V 33/00* (2006.01)
*F21L 4/00* (2006.01)

(52) U.S. Cl. ..... 362/183; 362/808; 362/190; 362/431; 362/396

(58) Field of Classification Search ..... 362/183, 362/102, 121, 186, 276, 806, 802, 190, 191, 362/253, 807, 808, 396, 431; 248/530, 156; 40/547

See application file for complete search history.

(56) References Cited

U.S. PATENT DOCUMENTS 4,304,076 A 12/1981 Splendora
5,252,893 A 10/1993 Chacham et al.
5,564,816 A * 10/1996 Arcadia et al. ..... 362/183
6,364,503 B1 * 4/2002 Wenzel et al. ..... 362/186
6,386,142 B1 * 5/2002 Holscher et al. ..... 119/57.8
6,588,723 B1 * 7/2003 Moran, III ..... 248/530
6,741,042 B1 * 5/2004 Tang ..... 315/291
2003/0221377 A1 * 12/2003 Crawford et al. ..... 52/103

* cited by examiner

*Primary Examiner*—Thomas M. Sember
(74) *Attorney, Agent, or Firm*—Barber Legal; Craig Barber

(57) ABSTRACT

A solar powered memorial light is used for grave-side, road-side or other memorials. The invention teaches that a small light may be solar powered so as to run at night: during the night-time, it may illuminate from within or without a small memorial or ornament. An eternal memorial of the invention may be the inscription on a headstone, or a plaque, etc. A typical ornament may be an angel, a religious figure, praying hands, or so on. The ornament of the invention may be translucent. It furthermore may comprise a staff having a first end adapted to be driven into the ground and a second end comprising a hook.

5 Claims, 4 Drawing Sheets

ETERNAL MEMORIAL LIGHT

CROSS-REFERENCE TO RELATED APPLICATIONS

This invention claims the priority and benefit of U.S. Provisional Patent Application 60/393,356, filed Jul. 1, 2002 in the name of the same inventor, Molly Reinmann, for Eternal Memorial Light.

FIELD OF THE INVENTION

This invention relates to generally to memorials, and specifically to a solar powered grave-side memorial.

STATEMENT REGARDING FEDERALLY FUNDED RESEARCH

This invention was not made under contract with an agency of the US Government, nor by any agency of the US Government.

BACKGROUND OF THE INVENTION

The typical grave, tomb, road-side memorial or other memorial presents a problem to well wishers of the deceased: the grave itself may last forever, but the items left as tokens of the esteem of visitors and well wishers probably will not.

Flowers left at a memorial or grave quickly fade and must eventually be removed by those in charge of the site. Artificial flowers last many times as long, but the fact that they are a copy of real flowers is often an embarrassment that makes them a less desirable token. Parents of deceased children sometimes bring toys, while photographs of the deceased tend to fade quickly.

There is an additional problem with such offerings: they tend to be visible in the day-light hours only. There are numerous reasons for this. The typical site such as a cemetery is large, out of doors, and landscaped: addition of outdoor lighting may be physically or financially impossible. Most well wishers visit during the daylight hours. Stringing electrical cables for long distances out of doors presents safety hazards and may obstruct the natural beauty of the location. It would be preferable to provide a device which provides a pleasing effect in daylight as well as night time.

Certain solar powered memorials are known which have various disadvantages. U.S. Pat. No. 5,564,816 issued Oct. 15, 1996 to Arcadia et al for ILLUMINATED MEMORIAL ASSEMBLY teaches a device intended for retrofit to a tombstone, and not having any separate support. It is further a metal device from which lights shines through an aperture.

U.S. Pat. No. 5,252,893 issued Oct. 12, 1993 to Chacham et al for LIGHT FLASHER APPARATUS teaches a circuit to extend life of headstone memorial batteries by flashing the light rather than shining steadily.

U.S. Pat. No. 4,304,076 issued Dec. 8, 1981 to Splendora for MONUMENTS teaches an actual headstone comprising a substantially transparent member generally dissimilar to the present invention.

These systems use the headstone itself as a support for a light assembly. Under some circumstances this may be advantageous, but in general it is preferable to provide a method of lighting which may use the headstone but which does not require use of the headstone. Other systems require that the installation be pre-installed on the headstone or grave site, or else require a great deal of work on the headstone, or a special transparent headstone, but in general it is preferable to provide a method of lighting which might be quickly retrofitted to any grave site, by driving the staff into the ground.

Finally, while known systems use opaque or transparent devices which essentially allow viewers to see through the ornament, a pleasing effect may be achieved by the use of translucent materials which provide an even glow to the ornament.

Thus, for a number of reasons, items left at memorials tend to either disappear quickly and not be visible at night, or not offer a pleasing appearance in the day, or may be expensive or difficult to install and maintain. Some systems rely on the headstone as a component or support for the eternal memorial ornament.

The present invention solves these problems and others.

SUMMARY OF THE INVENTION

General Summary

A solar powered memorial light is used for grave-side, road-side or other memorials. The invention teaches that a small light may be solar powered so as to run at night: during the night-time, it may illuminate from within or without a small memorial or ornament. An eternal memorial of the invention may be the inscription on a headstone, or a plaque, etc. A typical ornament may be a translucent angel, a religious figure, praying hands, or so on.

The invention teaches in the preferred embodiment that the eternal memorial light may be independent of the headstone, for example, it may be free standing by means of a support.

The invention furthermore teaches that the eternal memorial light may be easily retrofitted to an existing grave, thus allowing easy addition of the light to a pre-existing grave site, even grace sites having no head stone or other monument.

In the presently preferred embodiment and best mode now contemplated for carrying out the invention, the memorial comprises a shepherd's staff shaped support having a first end adapted to be driven into the ground and having a second end which forms a hook and at least one hollow ornament of translucent material having at least one loop, the loop and the hook cooperating to support the ornament when the hook is engaged with the loop. By means of the staff, almost any location can be provided with the memorial light of the invention.

The ornament furthermore has at least one solar-electricity cell; at least one light; and at least one rechargeable battery.

Summary in Reference to Claims

The present invention teaches in one aspect, advantage, objective and embodiment a memorial comprising: a shepherd's staff shaped support having a first end adapted to be driven into the ground and having a second end which forms a hook; at least one hollow ornament of translucent material having at least one loop, the loop and the hook cooperating to support the ornament when the hook is engaged with the loop; at least one solar-electricity cell; at least one light; and at least one rechargeable battery.

The present invention, in another aspect, objective, embodiment, and advantage, teaches a solar powered memorial comprising a free-standing support, a solar-electricity cell, a rechargeable battery, a light, the solar-electricity cell, battery and light being operatively connected, and a memorial ornament illuminated by the light.

The present invention, in one aspect, objective, embodiment, and advantage, teaches a solar powered memorial wherein the memorial ornament is able to stand free from the grave by means of a "shepherd's hook" support.

The present invention, in one aspect, objective, embodiment, and advantage, teaches a solar powered memorial wherein the memorial ornament is illuminated from within.

The present invention, in one aspect, objective, embodiment, and advantage, teaches a solar powered memorial wherein the memorial ornament is translucent plastic.

The present invention, in one aspect, objective, embodiment, and advantage, teaches a solar powered memorial wherein the memorial ornament resembles an angel.

The present invention, in one aspect, objective, embodiment, and advantage, teaches a solar powered memorial wherein the memorial ornament resembles a religious figure.

The present invention, in one aspect, objective, embodiment, and advantage, teaches a solar powered memorial wherein the memorial ornament resembles praying hands.

The present invention, in one aspect, objective, embodiment, and advantage, teaches a solar powered memorial wherein the memorial ornament resembles a candle.

The present invention, in one aspect, objective, embodiment, and advantage, teaches a solar powered memorial wherein the light illuminates the memorial ornament from the outside.

The present invention, in one aspect, objective, embodiment, and advantage, teaches a solar powered memorial wherein the memorial ornament comprises a headstone.

The present invention, in one aspect, objective, embodiment, and advantage, teaches a solar powered memorial wherein the memorial ornament comprises a plaque.

The present invention, in one aspect, objective, embodiment, and advantage, teaches a solar powered memorial wherein the solar cell has hinges allowing it to be oriented to the sun's light regardless of the orientation of the grave or memorial with which it is associated.

The present invention, in one aspect, objective, embodiment, and advantage, teaches a solar powered memorial wherein the memorial ornament may have an aperture allowing greater illumination of the larger memorial with which it is associated.

The present invention, in one aspect, objective, embodiment, and advantage, teaches a solar powered memorial wherein the light is a flood light.

The present invention, in one aspect, objective, embodiment, and advantage, teaches a solar powered memorial wherein the battery provides illumination during those times when the solar cell produces less electricity.

The present invention, in one aspect, objective, embodiment, and advantage, teaches a solar powered memorial wherein the times when the solar cell produces less electricity include the evening and night time hours.

INDEX TO REFERENCE NUMERALS

8 LOOP
10 MEMORIAL
12 ORNAMENT
14 SOLAR ELECTRICITY CELL
16 LIGHT
18 BATTERY
30 MEMORIAL LIGHT
34 SOLAR CELL
36 LIGHT
38 BATTERY
40 HINGE
42 HINGE
44 SUPPORT
46 HEADSTONE
50 STAFF
52 END
54 HOOK
60 ALTERNATIVE EMBODIMENT
62 SOLAR CELL MODULE
64 BATTERY/CAPACITOR MODULE
66 CONTROL MODULE
68 LIGHT MODULE

DETAILED DESCRIPTION

Figure 1:
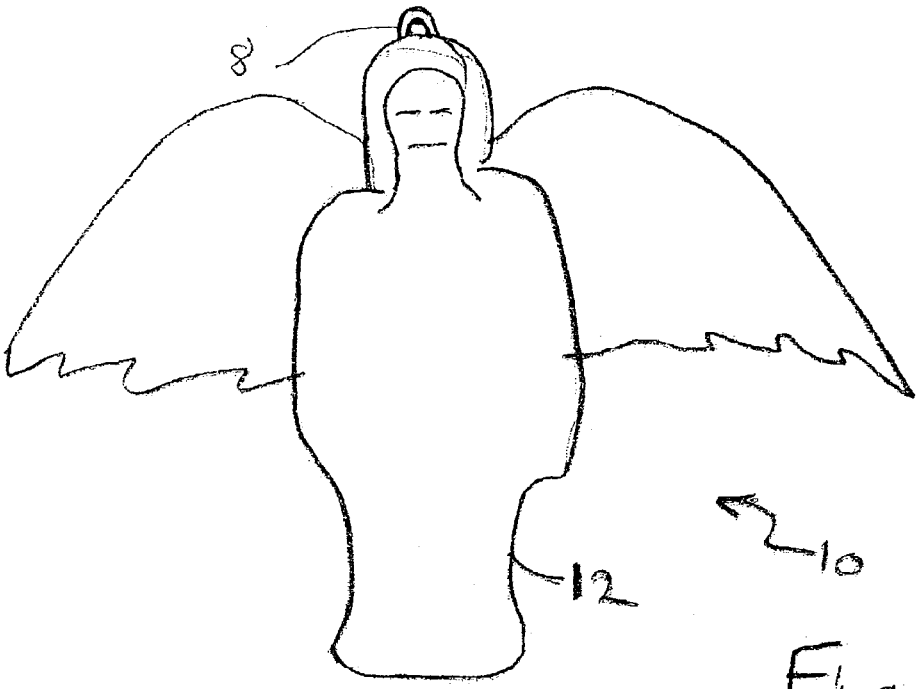
FIG. 1 is a frontal view of a first embodiment of the invention.

FIG. 1 is a frontal view of a first embodiment of the invention. This first embodiment serves as a portion of the presently preferred embodiment and best mode presently contemplated for carrying out the invention. Solar powered memorial 10 has memorial ornament 12 fashioned in the shape of an angel. Hook 8 is adapted, dimensioned and configured to cooperate with the hook of a shepherd's staff (not shown in FIG. 1). The front view of the invention may advantageously be constructed, dimensioned and configured so as to prevent easy viewing of the working components of the device. Advantageously, memorial ornament 12 may be made of translucent materials which allow light to pass, but which, unlike opaque or transparent materials, substantially block view of the interior of the invention.

Figure 2:
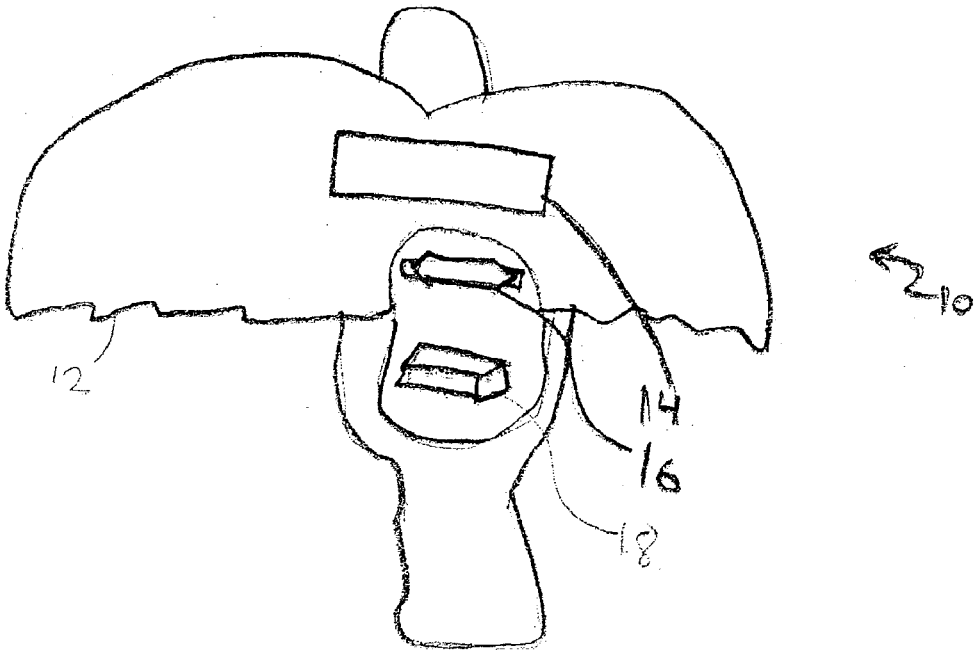
FIG. 2 is a partial-cutaway rear view of the first embodiment of the invention.

FIG. 2 is a partial cut-away rear view of the first embodiment of the invention. Externally visible on the back of memorial ornament 12 is solar-electricity cell 14, which is able to generate electricity from sunlight. By means of the partially cut-away view, light 16 and battery 18 may be seen in the interior of memorial ornament 12.

In operation, the user will install the eternal memorial of the invention at the desired location. Photons falling upon solar-electricity cell 14 are converted to electricity which is used to charge battery 18 or to drive light 16 directly. During the hours of darkness, electrical energy stored within battery 18 may be released to drive light 16. Whether it received electricity from battery 18 or cell 14, light 16 lights up memorial ornament 12 from within, providing a subdued light and showing memorial ornament 12 to best advantage.

Cell 14 may provide energy to light 16 in the daylight hours as well as the evening hours, by which means memorial ornament 12 may be illuminated in the daylight hours.

In the preferred embodiment, the decreasing energy output by cell 14 during times of dim light or darkness may cause battery 18 to begin providing energy to light 16. This may occur by means of the proper serial or parallel arrangement of the components, or, in alternative embodiments, an additional light sensor may be incorporated to control the flow of electricity within the device.

Figure 3:
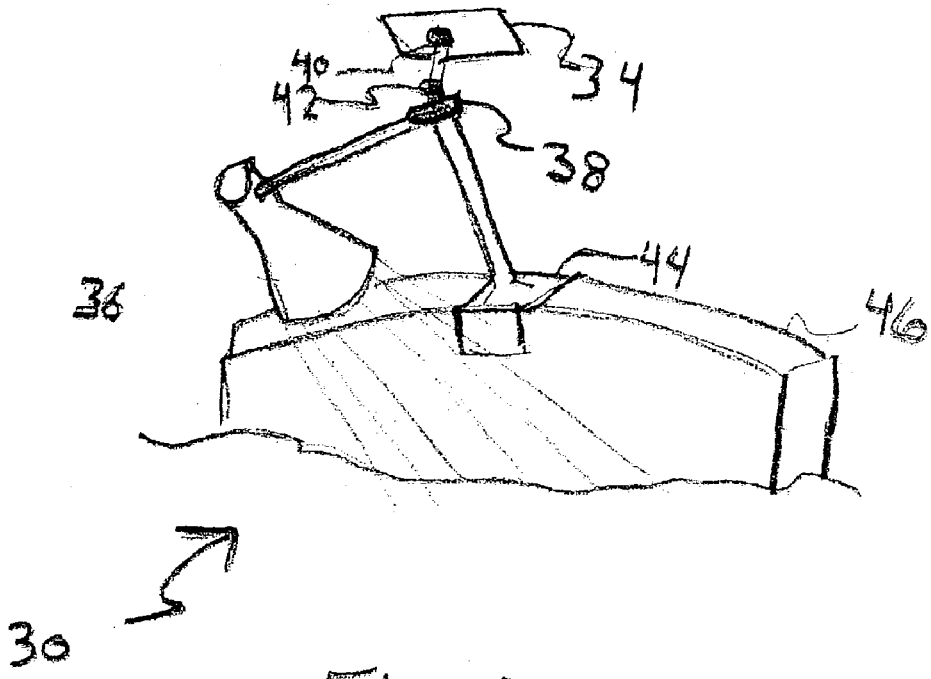
FIG. 3 is a frontal view of a second embodiment of the invention.

FIG. 3 is a frontal view of a second embodiment of the invention. In the second embodiment of the invention, the eternal memorial light 30 may itself have no decorative aspects, that is, it resembles a light appliance. Eternal memorial light 30 is used to light memorial ornament 46 externally: memorial ornament 46 is a headstone.

Eternal memorial light 30 may have support 44 which attaches to the top of headstone 46. Light 36 is held by eternal memorial light 30 in such a position that it illuminates the inscription (not pictured) on headstone 46. In this embodiment, light 36 may advantageously be of a focused nature, such as a flood light, so as to direct its light onto headstone 46 (the memorial ornament in this embodiment) but shield the eyes of anyone standing so as to read headstone 46.

As with the first embodiment previously discussed, the user will install the eternal memorial of the invention at the desired location. Photons falling upon solar-electricity cell 34 are converted to electricity which is used to charge battery 38 or to drive light 36 directly. During the hours of darkness, electrical energy stored within battery 38 may be released to drive light 36. Whether it received electricity from battery 38 or cell 34, light 36 lights up memorial ornament 46 from its external location. Advantageously, in the embodiment in which ornament 46 is a headstone, light 36 may angled so as to provide "relief" lighting of any incised inscriptions on headstone 46, that is, in inscription will have shadow in the letters and images of the inscription.

In the preferred embodiment, the decreasing energy output by cell 34 during times of dim light or darkness may cause battery 38 to begin providing energy to light 36. This may occur by means of the proper serial or parallel arrangement of the components, or, in alternative embodiments, an additional light sensor may be incorporated to control the flow of electricity within the device.

Hinges 40 and 42 of the second embodiment allow for easy adjustment of solar cell 34. It will be appreciated that for maximum energy generation, solar cells are normally oriented towards the south (towards the sun's light). By means of hinges 40 and 42, such orientation may be achieved without regard for the orientation of the grave or cemetery.

Figure 4:
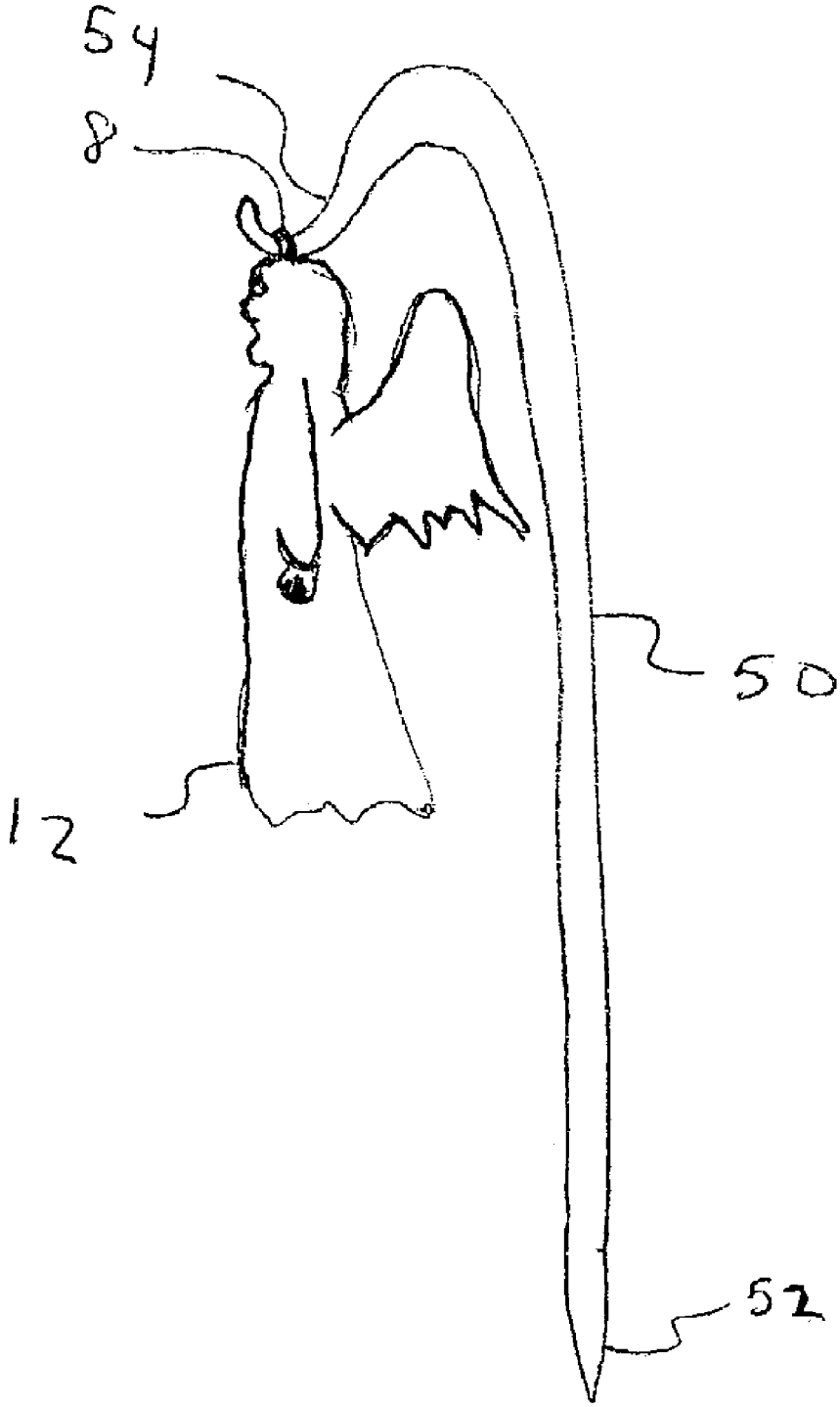
FIG. 4 is a side view of a third embodiment of the invention.

FIG. 4 depicts the presently preferred embodiment and best mode now contemplated for carrying out the invention. Ornament 12 has loop 8 which is dimensioned and configured to engage with hook 54 of shepherd's staff 50. (This may also be referred to as a 'shepherd's hook', a "shepherd's crook" or by other names.) While loop 8 and hook 54 engage in this embodiment by means of hook 54 passing through the aperture of loop 8 by choice of loop radius and thickness and hook diameter, other equivalent devices may fall within the scope of the claims later appended hereto.

Staff 50 has end 52 which is adapted, dimensioned and configured for being driven into the ground, so as to support ornament 12 near a grave site at a location determined by the well wisher. Staff 50 may be fashioned in the likeness of other items and end 52 may have a foot, a stand or other equivalent device without departing the scope of the claims later appended hereto.

In yet further embodiments of the invention, the illuminative and decorative embodiments of the invention may be combined. For example, ornament 12 of the first embodiment may be located in the location of light 36 of the second embodiment, so as to make viewing of a headstone, plaque, image of the deceased, etc, easy (as with the second embodiment) yet also provide an ornament such as an angle or religious figure, thus providing two illuminated ornaments: the internally illuminated figure and the externally illuminated headstone. In such an alternative embodiment, ornament 12 may have an aperture allowing light to pass out and illuminate the desired area.

Figure 5:
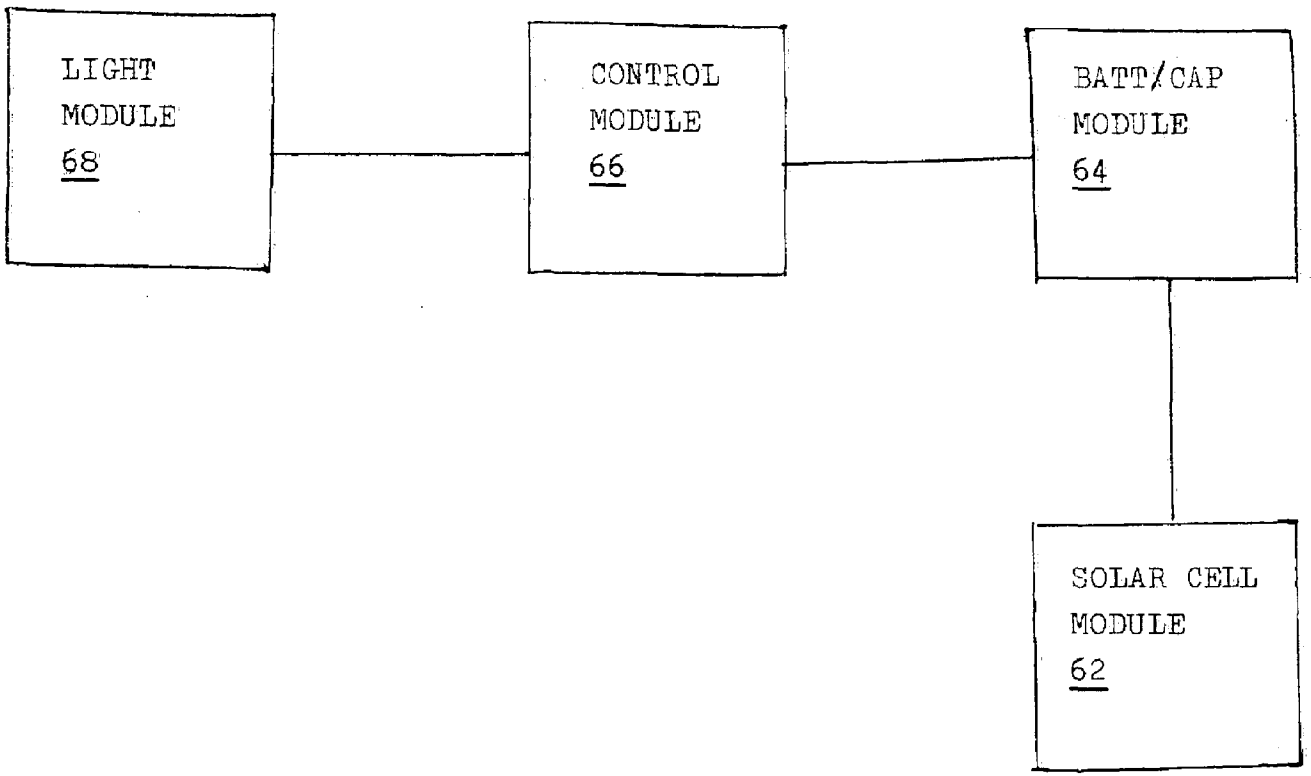
FIG. 5 is a block diagram (not an analog circuit) of major components of an electrical system according to the invention.

FIG. 5 is a block diagram (not an analog circuit) of major components of an electrical system according to the invention in an alternative embodiment 60. Solar cell module 62 provides electrical energy to battery/capacitor module 64. Control module 66 provides electrical energy to light module 68 as designed.

Control module 66 may be designed to provide electrical energy to light module 68 based upon time, light conditions, radio control, etc. For example, control module 66 may in embodiments comprise any one member of the group consisting of a timer, a light sensitive cell, a radio receiver, etc. In one embodiment, control module 66 may monitor the energy output of solar cell module 62 and when it falls below a set value, indicating the absence of light, may allow energy flow to light module 68.

Light module 68 may obviously comprise a single or plural light, mini-lights, one or more LEDs or HILEDs.

In use, the present invention may be provided to a pre-existing grave-site or other memorial by means of the staff. In a typical case, a user may select a portion of the grave site at which the light should be suspended. The location need not be the headstone, since the staff is self-supporting and free-standing. The staff is driven into the ground at the desired location. The depth to which the staff is driven may be selected by the user, thus allowing additional adjustment of the location of the light. The ornament is then hung from the hook end of the staff. The foot end of the shaft is thus advantageously sharp, pointed or otherwise provided with portions to aid in entering the earth.

In an alternative embodiment such as pictured in FIG. 3, the support may be clipped over the top of a headstone or other monument/memorial. The support may be a bracket as shown, or may be a large clip, a clamp, a race, a track, and similar device.

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the claims accompanying the disclosure.

I claim:

1. A lighted memorial for a grave or other memorial, the lighted memorial comprising:

a shepherd's staff shaped support having a first end adapted to be driven into the ground and having a second end which forms a hook;

at least one hollow ornament of translucent material having at least one loop, the loop and the hook cooperating to support the ornament when the hook is engaged with the loop;

at least one solar-electricity cell on the ornament;

at least one light in the interior of the ornament; and at least one rechargeable battery in the interior of the ornament, the light, the solar-electricity cell, and battery being operatively connected, and the memorial ornament illuminated by the light.

2. The memorial of claim 1, wherein the memorial ornament is translucent plastic.

3. The memorial of claim 1, wherein the memorial ornament resembles an angel.

4. The memorial of claim 1, wherein the memorial ornament resembles a religious figure.

5. The memorial of claim 1, wherein the battery provides illumination during times when the solar cell produces less electricity.

* * * * *